United States Patent [19]

Willcox

[11] 4,441,717

[45] Apr. 10, 1984

[54] GOLF BALL PRACTICE DRIVING APPARATUS

[76] Inventor: Leland J. Willcox, 75 Queens Dr., 7085 SE. Bloomfield Rd., Des Moines, Iowa 50320

[21] Appl. No.: 132,902

[22] Filed: Mar. 24, 1980

[51] Int. Cl.[3] ..... A63B 57/00

[52] U.S. Cl. ..... 273/201

[58] Field of Search ..... 273/201, 181 J, 182 R, 273/184 R, 26 D, 29 A, 202, 191 R; 124/50, 51 R, 45, 49

[56] References Cited

U.S. PATENT DOCUMENTS

| | | | |
|---|---|---|---|
| 2,212,877 | 8/1940 | Gale | 273/201 |
| 2,295,599 | 9/1942 | Mozel | 273/201 |
| 2,390,998 | 12/1945 | Gale | 273/201 |
| 3,003,770 | 10/1961 | Jones | 273/201 |
| 3,127,177 | 3/1964 | Benkoe | 273/201 |
| 3,756,606 | 9/1973 | Land | 273/201 |
| 3,758,118 | 9/1973 | Willcox | 273/201 |

FOREIGN PATENT DOCUMENTS

| | | | |
|---|---|---|---|
| 29921 | 7/1979 | France | 273/201 |

*Primary Examiner*—Richard C. Pinkham
*Assistant Examiner*—T. Brown
*Attorney, Agent, or Firm*—Rudolph L. Lowell

[57] ABSTRACT

The golf practice driving apparatus is adapted for individual home use or for use commercially on a driving range. The apparatus has a ball supply container from which the balls are individually fed to a movable ball transfer member that in a first moved position receives a ball, and in a second moved position, delivers the ball to a teed position on a tee member. The tee member is movable between a ball receiving position and a ball driving position and is interconnected with the transfer member by a releasable locking means so that the weight of a ball in a teed position depresses the tee member to release the transfer member for movement from the second position to the first position therefor, wherein the transfer member is locked to receive a ball from the ball container and the teed ball is fully exposed for driving. When the teed ball is driven, the tee member is movable to concurrently release the transfer member for movement to the second position therefor. This movement of the transfer member is provided by the weight of the ball that was received thereon concurrently with the seating on the tee member of the ball to be driven. The transfer member, in moving from the second position to the first position therefor also functions as an actuator to operate a ball holding mechanism to release only a single ball from the ball container to the transfer member. This cycle of operations takes place automatically each time a ball is driven from a teed position on the tee member until the ball container has been emptied.

5 Claims, 12 Drawing Figures

-60-

GOLF BALL PRACTICE DRIVING APPARATUS

BACKGROUND OF THE INVENTION

It is now common for many golfers to practice driving at so-called "driving ranges" rather than at the golf course. At the driving ranges the golfer is supplied with a bucket of balls and assigned a location having an "in-place" tee, or he may have to supply his own tees. In either event, it is necessary to individually select and tee up a ball for each drive. This action consumes time and detracts the golfer's attention from concentrating on any swing correction appearing from a previous drive. Additionally, the golfer is required to visit a driving range or a golf course for practice driving purposes. To eliminate some of this inconvenience, there have been provided practice machines such as shown in U.S. Pat. No. 3,758,118, which can be used indoors for commercial purposes, or for individual home use by a golfer. This golfing machine is foot operated to feed successive balls into a teed position, and provides visual indications of the direction and speed of the driven ball. However, the machine is relatively heavy, expensive and of a size to require appreciable space for both storage and use.

SUMMARY OF THE INVENTION

The golf driving apparatus is of a compact, light weight construction for ready transport by one person and of a size to be stored and used in a relatively small space. The apparatus is efficient in operation to automatically feed single balls from a ball container to a teed position. The balls to be driven are received on a ball transfer member that is pivotally movable from a first releasably locked ball receiving position to a second releasably locked ball transfer position. In the second releasably locked position, a ball is transferred by gravity action to a seated or teed position on a tee member which is movable to function as an actuator relative to the locking means. The tee member is depressed by the weight of the seated ball to release the locking means and permit movement of the transfer member to the first releasably locked position therefor wherein the teed ball is fully exposed for driving. During this movement, the next ball to be driven is supplied to the transfer member. When the teed ball is driven and the weight thereof is thus removed from the tee member, the tee member moves upwardly to release the locking means and permit the transfer member to return to its first releasably locked position. As the transfer member approaches the first position therefor, it functions as an actuator to operate a ball holding mechanism to feed the next ball to be driven onto the transfer member. This cycle of operations is then repeated so that the balls are automatically fed in succession to a teed position for driving until the supply of balls in the ball container has been exhausted.

DESCRIPTION OF THE INVENTION

Figure 1:
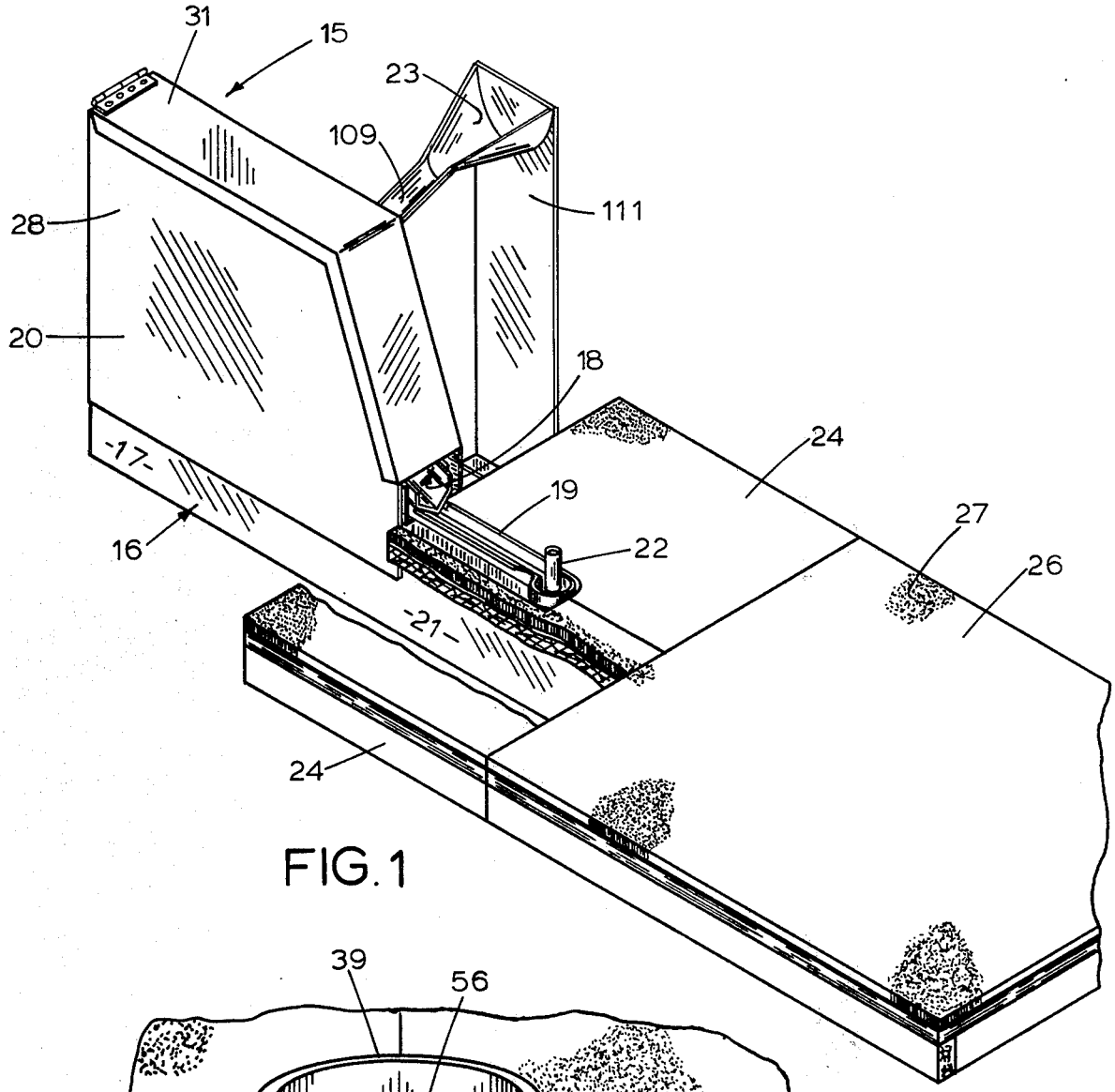
FIG. 1 is a perspective view of the golf driving apparatus of this invention.

With reference to FIG. 1, the golf driving apparatus of this invention is seen to include a frame structure 15 having an elongated base member 16 of a generally inverted U-shape in transverse section and a housing 20 supported on what will, for convenience, be called the rear section 17 of the base member 16. A ball transfer member 18 pivotally supported on the frame structure for a teeter-totter movement has a front section 19 projected forwardly from the housing 20 and over the front section 21 of the base member for termination adjacent a tee member 22. The tee member projects upwardly from the front base section 21 and is movably supported thereon for up and down movement between a ball seating position and a ball driving position. Golf balls from a storage chamber or container 23 carried adjacent the upper end and exteriorly of the housing 20 are sequentially and automatically supplied to the transfer member 18 for delivery to a teed position on the tee member 22 in response to the driving of a ball from the tee member.

Ground supported platform sections 24 are suitably secured to opposite sides of the base front section 21 and to a front platform section 26. The platform sections 24 and 26 constitute the standing area for a golfer and are substantially equal in height to the height of the base member 16 so as to form a substantially continuous floor surface with the upper side 47 of the base member. The platform sections may be covered by a thick mat material 27 (FIG. 1) having portions extended over the front base section 21 so as to leave exposed only the projected tee member 22 and the front section 19 of the transfer member 18. There is thus a minimum of distraction to the golfer adjacent the tee member prior to and during his drive.

The housing 20 (FIGS. 1 and 5) is comprised of a pair of upright side members 28 and a rear wall 29 secured suitably at their lower ends to the base member rear section 17. A cover member 31 forms the top wall and front wall for housing 20 and is hingedly supported at its rear end to the upper end of the rear housing wall 29 for upward pivotal movement to an open position to give access to the interior of the housing 20.

The transfer member 18 (FIGS. 3, 4 and 5) is of an angulate shape with the front section 19 and a rear section 32 constituting a pair of upwardly diverging leg sections the adjacent ends of which are connected together by a pivoted coupling member or bracket 33. The rear leg section 32 is of a generally trough form in transverse section (FIG. 4) and the coupling member 33 is of a U-shape in transverse section and of a width to receive between the upper ends of the leg sections 34 thereof the front end of the transfer member rear section 32. The rear section 32 and the coupling unit 33 are rigidly secured together by the fastening members indicated at 37.

The front leg section 19 of the transfer member 18 (FIGS. 2 and 3) is of a generally elongated U-shape in plan view having a pair of leg sections 38 connected together by a base section 39 of a generally circular shape and open between the legs 38. The section 19 is formed from a flat strap material with the transverse dimension thereof projected upwardly. The top sides of the leg sections 38 terminate in outwardly and upwardly inclined ball guides 41 arranged in substantial longitudinal alignment with the side portions **32*a* of the rear leg section 32** of the transfer member so as to form therewith a substantially continuous guideway for the travel of a ball on the transfer member.

Figures 3, 4:
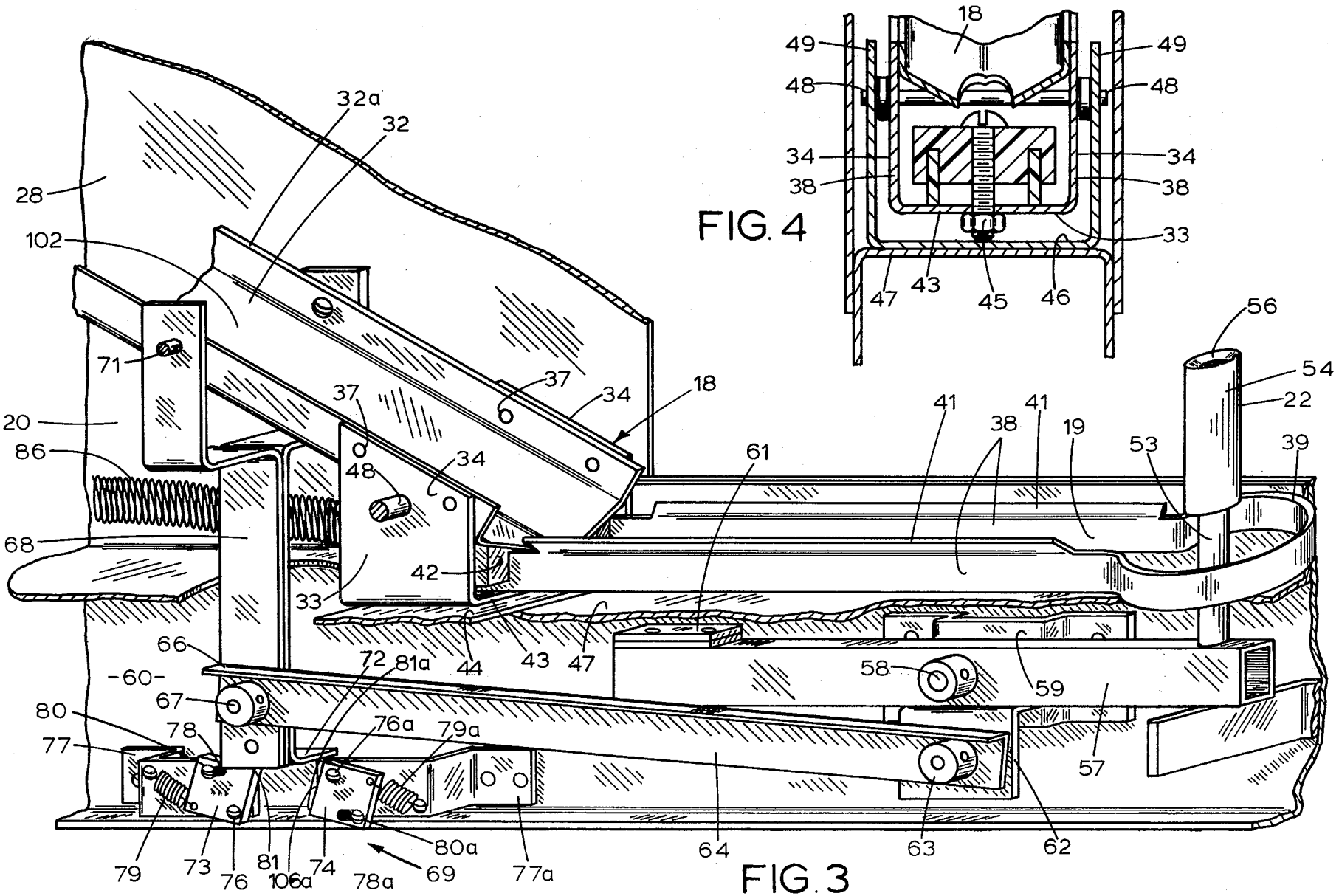
FIG. 3 is an enlarged fragmentary perspective view showing the interconnection of a ball transfer member and a tee member with a releasable locking mechanism which forms part of the apparatus of this invention.
FIG. 4 is a fragementary perspective view showing the assembly relation of the transfer member with the supporting structure therefor.

The free or rear ends of the legs 38 of the transfer member front section 19 are embedded within a plastic block member 42 which is positively secured (FIG. 4) to the base portion 43 of the coupling 33 by a bolt assembly 45. The transfer member 18 is thus of a unit construction with the angular relation between the front section 19 and the rear section 32 thereof being fixed by their assembly relation with the coupling member 33. As shown in FIGS. 1 and 3, the transfer member 18 extends longitudinally of the housing 20 with the rear section 32 positioned between the side walls 28 thereof and the front section 19 extended over the front section 21 of the base member 16.

The coupling member 33 is arranged in a nested spaced relation within a mounting member 44, of a corresponding U-shape, the base member 46 of which is suitably secured to the upper or top side 47 of the base member 16 (FIG. 4). The coupling member 33 is fixed on a pivot shaft 48 which is pivotally supported in the legs 49 of the mounting member 44 to provide for an up and down pivotal or teeter-totter movement of the transfer member 18 from a first position (FIG. 5) wherein the rear end 51 of the transfer member 18 is arranged relative to a ball discharge chute 52 to receive a single ball therefrom and the front section 19 of the transfer member is extended substantially horizontally in a plane adjacent the lower end of the tee member 22 to fully expose a ball to be driven; to a second position (FIG. 7) for transfer of the ball received from the discharge chute 52 to a seated position on the tee member 22.

The tee member 22 (FIGS. 2 and 3) is arranged in a concentrically spaced relation within the base section 39 of the transfer member front section 19 and includes a rod like cylindrical lower member 53 and an upper tubular member 54 formed of a rubber or like resilient material fitted in a telescopic relation about the top end of the cylindrical member 53. The top end of the tubular member 54 is formed with a seat 56 of a size to receive in a seated relation therein the lower portion of a golf ball.

The tee member 22 is secured to and projects upwardly from a pivoted balance bar 57 located within and extended longitudinally of the front section 21 of a base member 16 (FIG. 3). The balance arm 57 is fixedly mounted intermediate its ends on a rock shaft 58 rockably supported on a bracket member 59 that is secured to a side wall 60 of the base front section 21. The weight of the tee member 22 on the balance arm 57 is counterbalanced by a weight 61 fixed on the balance arm on the end thereof opposite the tee member 22. A rock arm 62 fixed on the balance arm 57 is pivotally connected at 63 to one end of a lever 64, the opposite end 66 of which is pivotally connected at 67 to a latch member 68 that forms part of a releasably locking mechanism indicated generally at 69.

The latch member 68 (FIGS. 3 and 10) extends upwardly toward the rear section 32 of the transfer member 18 at a position rearwardly of the mounting member 44 and has its upper end of a bifurcated construction for pivotal connection at 71 with opposite sides **32*a* of the transfer member rear section 32. The lower end of the latch member 68 terminates in a lateral projection or latch abutment 72 for selective coacting engagement with a pair of locking members 73 and 74. The locking members 73 and 74 (FIGS. 3 and 5) are spaced longitudinally of the base member 16 a distance apart to provide for the up and down movement therebetween of the latch abutment 72. The locking member 73 (FIG. 3) is pivoted at 76 on a support member 77 suitably secured to the base member side wall 60. The locking member 73 is of a generally square shape in side elevation and diagonally opposite the pivot 76 is formed with an arcuate slot 78 for receiving a pin 80 on the supporting member 77 to limit the pivotal movement of the member 73 about its pivotal axis 76. A spring 79 yieldably urges the locking member 73 in a clockwise direction about the pivot 76 to locate the stop abutment or corner 81 thereof in the up and down path of movement of the latch abutment 72. The locking member 74 is similar in construction, assembly, and in its operation relative to the latch abutment 72 to the locking member 73**. Like parts thereof are indicated by like numbers with the suffix A.

As thus far described, it is seen that in response to an up and down movement of the tee member 22, the resultant rocking movement of the balance arm 57 that the latch member 68 is pivotally moved through the rock arm 62 and lever 64 for engagement of the latch abutment 72 with one or the other of the locking members 73 or 74. As will appear later, this pivotal movement of the latch abutment 72 takes place concurrently with an up and down movement of the latch member 68 in response to the pivotal movement of the transfer member 18 to selectively lock the transfer member in the ball receiving and driving position or the ball transfer position therefor.

Figures 5, 6:
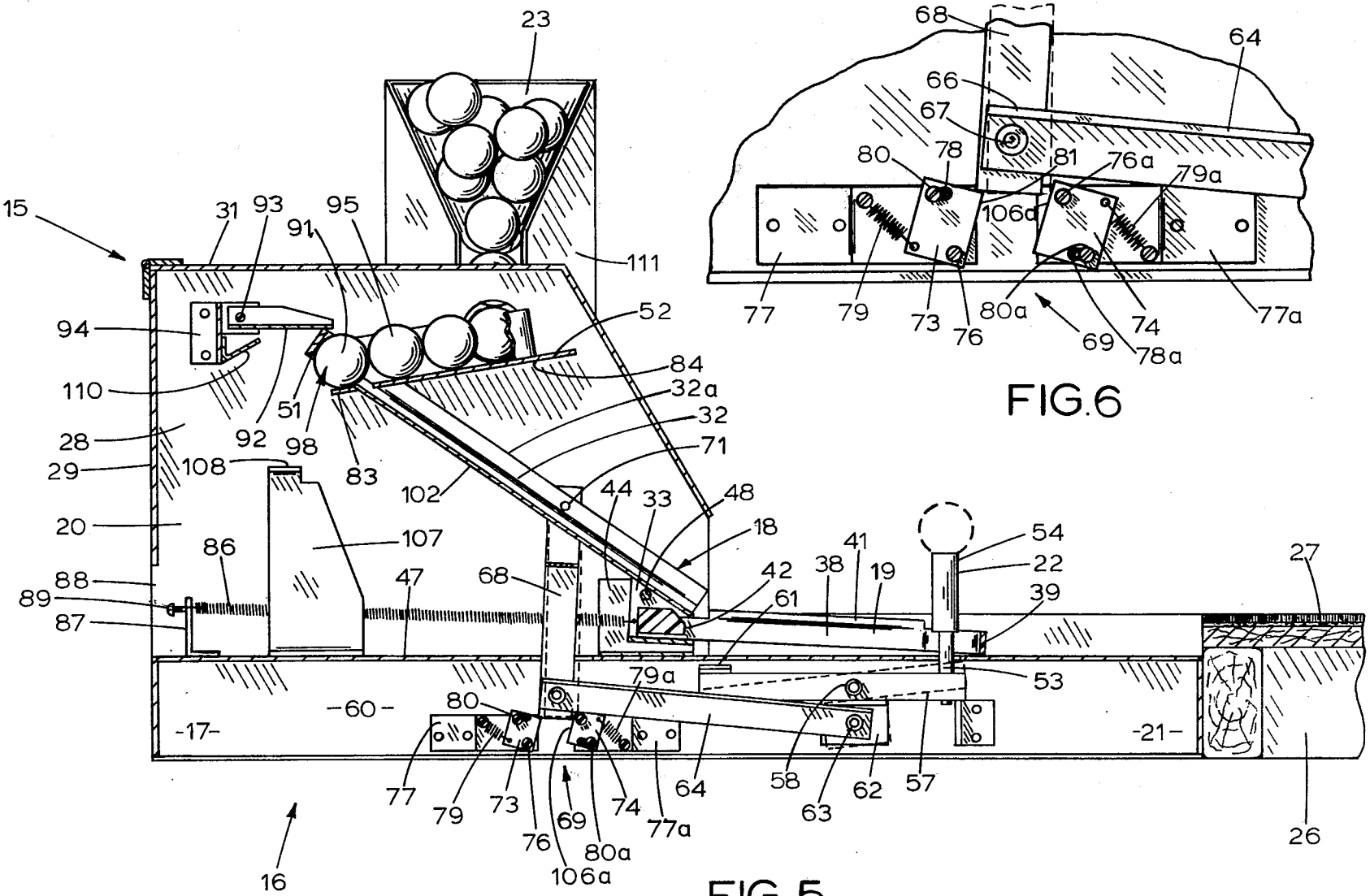
FIG. 5 is a longitudinal sectional view of the apparatus in FIG. 1 showing the ball transfer member in a ball receiving position therefor and releasably locked against movement to the ball transfer position.
FIG. 6 is an enlarged showing of the releasable locking mechanism illustrated in FIG. 5 with parts thereof broken away to more clearly show their relative position.

In the use of the golf driving apparatus of this invention, let it be assumed that the ball transfer member 18 is in the ball receiving and ball driving position therefor shown in FIG. 5. In this position, the rear section 32 of the transfer member is inclined upwardly and rearwardly from the pivot support 48 and the front section 19 is extended substantially horizontally adjacent the upper side of the base member 16 with the rear section 32 being of a length to provide for the projection of its upper or rear end 51 across and in an intersecting relation with the discharge end of the ball chute 52. This position of the transfer member 18 is defined by the engagement of its rear end 51 with the bottom side 84 of the ball chute 52. Movement of the transfer member 18 to the ball receiving and driving position is provided by an adjustable tension spring 86 that is connected at one end to the plastic block 42 and at its opposite end to an upright bracket 87 that is secured to the upper side 47 of the base member 16 adjacent the rear end thereof. An opening 88 in the housing rear wall 29 provides access to an adjustment screw 89 for varying the tension in the spring 86.

Figure 11:
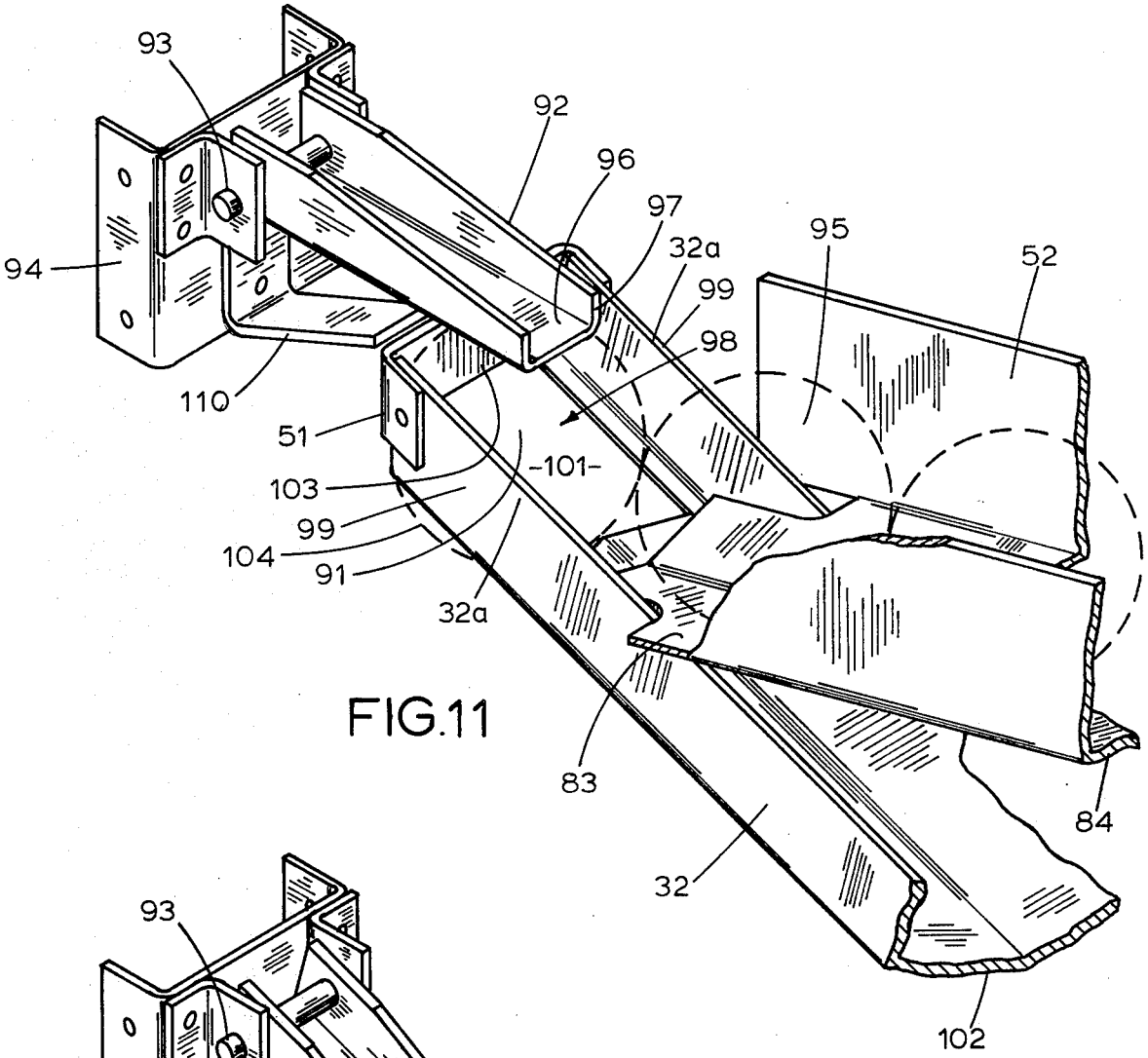
FIG. 11 is an enlarged fragmentary perspective view of the ball discharge chute showing the ball holding mechanism actuated by the transfer member to release a ball from the chute to the transfer member.

It should also be noted that when the transfer member 18 is in the ball receiving and driving position therefor, that its rear end 51 is engageable with and holds a pivoted ball retaining finger 92 out of engagement with the lead ball 91 in the ball chute 52 (FIGS. 5 and 11). The retaining finger 92 extends generally longitudinally of the housing 20 and has its rear end pivoted at 93 on a bracket 94 that is secured to side walls 28 of the housing 20 at a position upwardly and rearwardly of the ball chute 52. In a ball retaining position, as will appear later (FIGS. 7 and 12) the forward end 96 of the retaining finger 92 has its terminal front face 97 in abutting engagement with the lead ball 91 in the chute 52 to retain such ball against movement out of the chute 52.

With the transfer member 18 in its position of FIG. 5, the lead ball 91 is receivable at the rear end 51 of the transfer member in a pocket indicated generally at 98 in FIGS. 5 and 11 defined by the side walls 99 of a slot 101 formed in the bottom wall 102 of the transfer member rear section 32 and a confining wall 103 connected across the rear ends of the section side members 32*a*. The opening 101 is of a size to retain the lead ball 91 therein against movement longitudinally of the transfer member while permitting the lower portion 104 of the lead ball to project downwardly below the bottom wall 102.

With further reference to FIG. 5, it is seen that when the lead ball 91 is received within the pocket 98, the tee member 22 is in the upwardly moved dotted line position therefor provided by the weight 61 on the balance arm 57. This counterclockwise movement of the balance arm 57 relative to the rock shaft 58 actuates the rock arm 62 to move the lever 64 toward the right, as viewed in FIG. 5, whereby to position the latch abutment 72 against the cam side 106A of the locking member 74 and out of a position for engagement with the stop abutment 81 of the cam member 73, as indicated in dotted lines in FIGS. 5 and 6. As a result, the latch abutment 72 is out of engagement with either of the stop abutments 81 or 81A so that the transfer member 18 is pivotally movable relative to the pivot 48.

Figure 2:
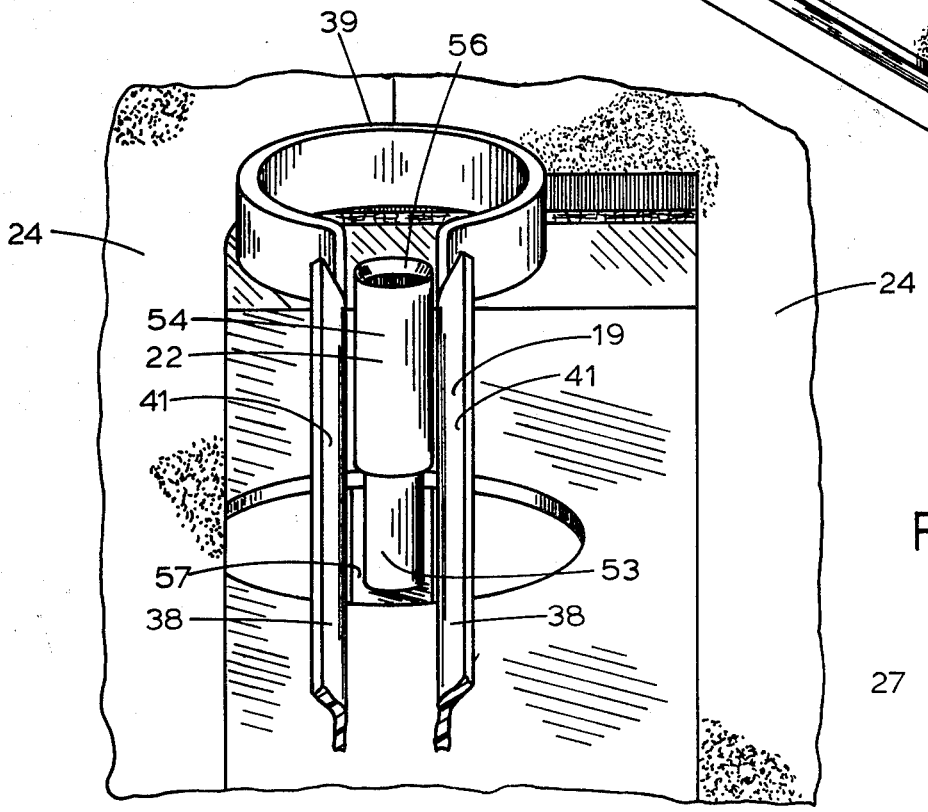
FIG. 2 is an enlarged sectional view taken along the line 2—2 in FIG. 7.
Figure 7:
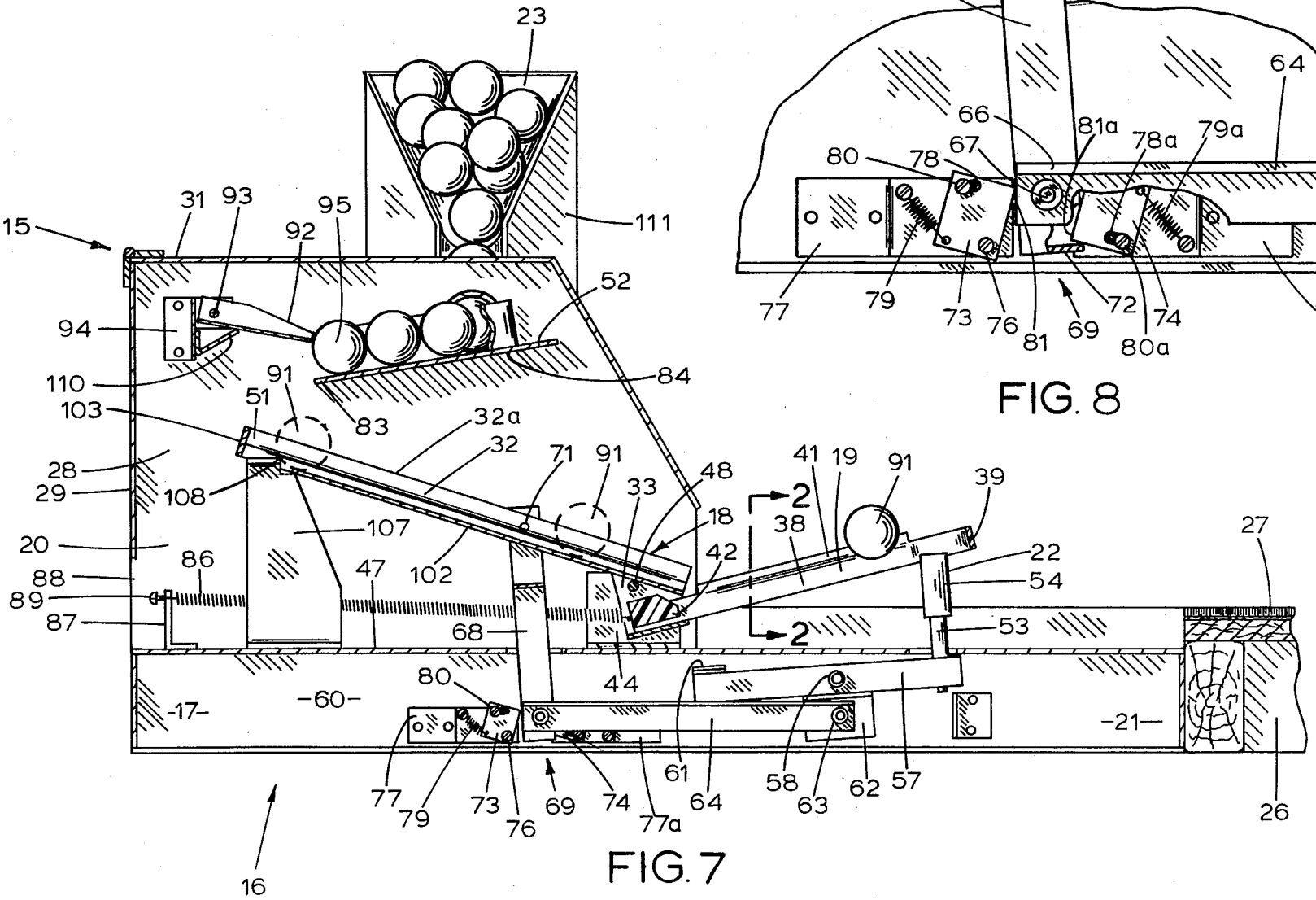
FIG. 7 is a longitudinal sectional view illustrated similar to FIG. 5 showing the ball transfer member in a position for delivering a ball to a teed position on a tee member, and a ball holding mechanism releasably holding the next ball to be driven.

The weight of the lead ball 91 at the rear end 51 of the transfer member 18 is sufficient to overcome the pressure of the tension spring 86 to provide for the movement of the transfer member 18 from its position in FIG. 5 to its ball transfer position shown in FIG. 7, which is defined by the engagement of the rear end 51 of the transfer member with the upper end of a stop plate 107 projected upwardly from the upper side 47 of the base member 16. Concurrently with such defined engagement, the ball ejector 108 on the stop plate 107 engages the lower portion of the lead ball and moves such ball 91 out of the pocket 98 for rolling down the transfer member rear section 32 and then upwardly on the front section 19 (FIG. 7) to a seated position on the tee member 22. The seating or teeing of the ball 91 on the tee member 22 takes place by virtue of the guiding and confining action of the arcuate retaining wall or base 39 which forms an extension of the transfer member front section 19. Thus, as shown in FIGS. 2 and 7, the retaining wall 39 is positioned in a generally concentrically spaced relation about the seat 56 of the tee member 22. As the ball 91 leaves the legs 38 of the front section 19, it drops onto the top of the tee member 22 and being confined by the wall 39 comes to rest on the seat 56.

Figure 8:
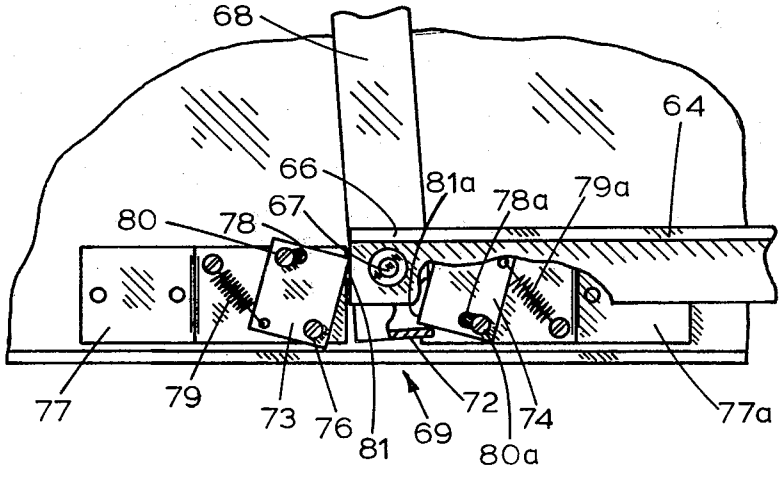
FIG. 8 is an enlarged showing of the releasable locking mechanism in FIG. 7 with certain parts broken away for clarity.

Concurrently, with the transfer member 18 moving into its ball transfer position of FIG. 7, the latch member 68 is moved downwardly to in turn move the latch abutment 72 along the cam side 106A of the locking member 74 for releasable locking engagement with the stop abutment 81A (FIG. 8). As a result, the transfer member is locked in its ball transfer position against clockwise movement about the pivot 48 during the travel of the lead ball 91 upwardly of the transfer member front section 19.

Figure 12:
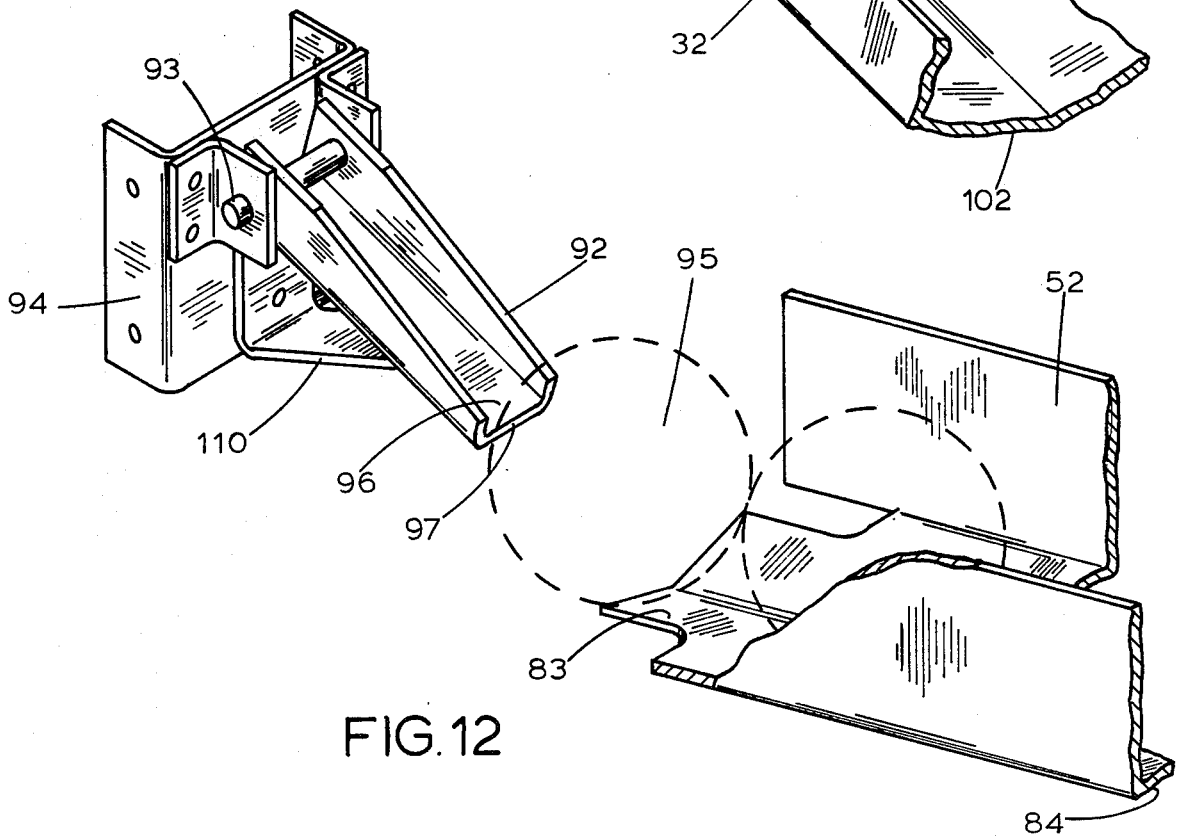
FIG. 12 is an enlarged fragmentary view showing a ball held on the discharge chute by the ball holding mechanism while a preceding ball is being delivered by the transfer member to the tee member.

As the transfer member 18 with the lead ball 91 thereon moves from the ball receiving position therefor to the position shown in FIG. 7, the retaining finger 92 moves downardly by gravity in a following relation with the transfer member rear end 51 to a stop position defined by its engagement with an abutment member 110 carried on the bracket 94 and projected forwardly therefrom below the pivot 93. In this finger stop position, the front face 97 is engageable with the next lead ball 95 to hold such ball against discharge from the ball chute 52 (FIGS. 7 and 12).

Figures 9, 10:
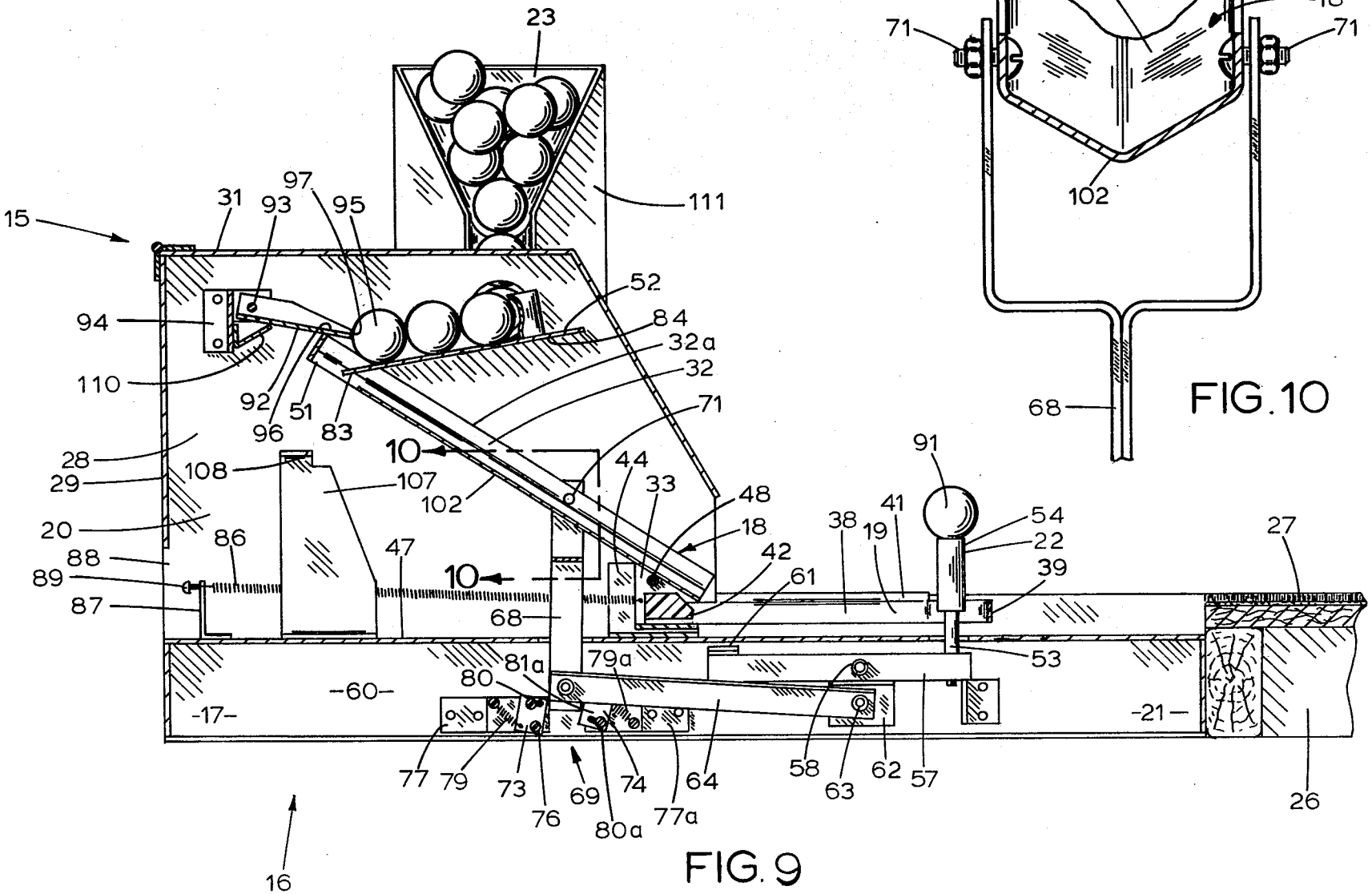
FIG. 9 is illustrated similarly to FIG. 7 and shows the actuation of the ball holding mechanism by the transfer member as it approaches the ball receiving position therefor and wherein the teed ball is exposed for driving.
FIG. 10 is an enlarged sectional view as seen on the line 10—10 in FIG. 9.

When the lead ball 91 is seated on the tee member 22, the weight thereof depresses the tee member from its position in FIG. 7 to the ball teed position thereof shown in FIG. 9. During this depressing movement of the tee member 22, the rock arm 62 is moved in a clockwise direction relative to the rock shaft 58 whereby the lever 64 is moved to the left as viewed in FIG. 9 moving latch arm 68 out of engagement with the stop abutment 81A. This release of the latch arm 68 permits pivotal movement of the transfer member 18 in a clockwise direction relative to the shaft 48 in response to the biasing action of the tension spring 86. As the transfer member reaches the position shown in FIG. 9, the rear end 51 thereof engages and moves the retaining finger 92 upwardly and out of engagement with the next lead ball 95. The upward movement of the latch member 68 concurrently with its lateral movement toward the left, as viewed in FIG. 9, in response to the downward movement of the tee member 22 moves the latch abutment 72 into engagement with the cam side 106 of the locking member 73 to the releasable locked ball receiving position therefor shown in full lines in FIGS. 5 and 6. It is seen, therefore, that a next lead ball on the chute 52 is received on the transfer member 18 and that the transfer member is releasably locked against counterclockwise pivotal movement about the shaft 48 so long as the first lead ball 91 (shown in dotted lines in FIG. 5) is seated on the tee member 22. Importantly, it is to be noted that the transfer member front section 19 is extended horizontally adjacent the lower end of the member 22 so as to leave the seated ball fully exposed for driving free of any obstruction from the transfer member 18. Additionally, the front section 19 is locked against movement upwardly of the tee member, until after the ball has been driven.

On driving of the ball 91 from the tee member 22, the tee member is moved upwardly by the ball counterweight 61 and the balance arm 57 is moved in a counterclockwise direction on the rock shaft 58. The rock arm 62 being moved in the same direction the latch abutment 72 is actuated out of engagement with the cam member 73 to the dotted line position therefor shown in FIGS. 5 and 6. The transfer member 18 is thus again permitted to be pivotally moved in counterclockwise direction about the pivot 48 by the weight of the next lead ball 95 thereon. The lead ball 95 is then transferred to a seated position on the tee member 22 in all respects the same as the preceding lead ball 91 and this cycle of operation is repeated until the supply of balls in the container 23 has been exhausted.

As shown in FIG. 1, the container 23 is of a generally half funnel shape spaced upwardly from the outlet 109 thereof which is in register with the ball chute 52. In this respect, it is to be noted that both the container 23 and the ball chute 52 are inclined downwardly to provide for a gravity flow of a ball from the container 23 to the discharge end of the ball chute 52. The large end of the half funnel shape container 23 is closed by an upright supporting plate 111 which is of a length to function as a ground support for the container.

Although the invention has been described with respect to a preferred embodiment thereof, it is to be understood that it is not to be so limited since changes and modifications can be made therein which are within the full intended scope of this invention as defined by the appended claims.

I claim:

1. A golf ball practice driving apparatus for successively teeing up golf balls comprising:

(a) a ground supported upright frame structure including a base member having a section projected from one end of said frame structure, (b) a tee member projected upwardly from said base section and movably supported on said base member for movement from an upper ball receiving position to a lower ball driving position, said tee member movable from the ball receiving position to the ball driving position therefor by the weight of a ball received threreon, (c) a container for golf balls mounted on an upper portion of said frame structure having a discharge chute for a single row of golf balls, (d) means on said frame structure for releasing only the lead ball from said chute, (e) a ball transfer member movable from a first position to receive a ball thereon to a second position to transfer the ball to a teed position on said tee member, when the tee member is in the ball receiving position therefor, (f) first means for releasably locking the transfer member in said first position, when the tee member is in the lower ball driving position therefor, (g) second means for releasably locking the transfer member in said second position, when the tee member is in the upper ball receiving position therefor, (h) means interconnecting said transfer member and tee member for actuation of said first releasable locking means and said second releasable locking means in response to the concurrent movements of the tee member and the transfer member, (i) said transfer member, when the tee member is in the upper ball receiving position therefor, being releasably locked by said second locking means on movement thereof from the first position to the second position therefor in response to the weight of a ball delivered thereon from said chute and being sequentially released by the second locking means for movement from the second position to the first position therefore, and releasably locked in the first position therefor by the first releasable locking means, in response to the movement of the tee member from the upper ball receiving position to the lower ball driving position therefor, (j) said first releasable locking means being released in response to the driving of a ball from the tee member to provide for the movement of the transfer member from the first position to the second position therefor, in response to the weight of a next lead ball delivered from the chute, (k) means for releasing the lead ball for delivery on the transfer member in response to movement of the transfer member from the second position to the first position therefor, (l) said first releasable locking means including a first stop abutment pivotally supported on said base member for movement about a first transverse axis, and (m) said second releasable locking means including a second abutment member pivotally supported on said base member for movement about a second transverse axis spaced longitudinally from said first transverse axis, and (n) a latch abutment common to said first and second stop abutments movably connected to the transfer member for movement into locked engagement with one or the other of said first and second stop abutments in response to the concurrent movements of the transfer member and tee member.

2. A golf ball practice driving apparatus for successively teeing up golf balls comprising:

(a) a ground supported upright frame structure including a base member having a section projected from one end of said frame structure, (b) a tee member projected upwardly from said base section and movably supported on said base member for movement from an upper ball receiving position to a lower ball driving position, said tee member movable from the ball receiving position to the ball driving position therefor by the weight of a ball received thereon, (c) a container for golf balls mounted on an upper portion of said frame structure having a discharge chute for a single row of golf balls, (d) means on said frame structure for releasing only the lead ball from said chute, (e) a ball transfer member movable from a first position to receive a ball thereon to a second position to transfer the ball to a teed position on said tee member, when the tee member is in the ball receiving position therefor, (f) first means for releasably locking the transfer member in said first position, when the tee member is in the lower ball driving position therefor, (g) second means for releasably locking the transfer member in said second position, when the tee member is in the upper ball receiving position therefor, (h) means interconnecting said transfer member and tee member for actuation of said first releasable locking means and said second releasable locking means in response to the concurrent movements of the tee member and the transfer member, (i) said transfer member, when the tee member is in the upper ball receiving position therefor, being releasably locked by said second locking means on movement thereof from the first position to the second position therefor in response to the weight of a ball delivered thereon from said chute and being sequentially released by the second locking means for movement from the second position to the first position therefor, and releasably locked in the first position therefor by the first releasable locking means, in response to the movement of the tee member from the upper ball receiving position to the lower ball driving position therefor, (j) said firt releasable locking means being released in response to the driving of a ball from the tee member to provide for the movement of the transfer member from the first position to the second position therefor, in response to the weight of a next lead ball delivered from the chute, (k) means for releasing the lead ball for delivery on the transfer member in response to movement of the transfer member from the second position to the first position therefor, (l) said ball releasing means actuated by the transfer member as the transfer member moves from the second position to the first position therefor to release a ball for delivery on the transfer member in the first position therefor, (m) stop means on the frame structure engageable with said transfer member to define said first position therefor, (n) said ball releasing means including a stop finger, and (o) means pivotally supporting the stop finger on said frame structure for up and down pivotal movement of one end thereof relative to said discharge chute, (p) said stop finger engageable with the lead ball in the chute when said one end is in a down position therefor, and disengaged with the lead ball in the chute when said one end is in the up position therefor, (q) said stop finger being engaged by said transfer member for movement to the up position thereof concurrently with movement of the transfer member to the first position therefor.

3. A golf ball practice driving apparatus for successively teeing up golf balls comprising:

(a) a ground supported upright frame structure including a base member having a section projected from one end of said frame structure, (b) a tee member projected upwardly from said base section and movably supported on said base member for movement from an upper ball receiving position to a lower ball driving position, said tee member movable from the ball receiving position to the ball driving position therefor by the weight of a ball received thereon, (c) a container for golf balls mounted on an upper portion of said frame structure having a discharge chute for a single row of golf balls, (d) means on said frame structure for releasing only the lead ball from said chute, (e) a ball transfer member movable from a first position to receive a ball thereon to a second position to transfer the ball to a teed position on said tee member, when the tee member is in the ball receiving position therefor, (f) first means for releasably locking the transfer member in said first position, when the tee member is in the lower ball driving position therefor, (g) second means for releasably locking the transfer member in said second position, when the tee member is in the upper ball receiving position therefor, (h) means interconnecting said transfer member and tee member for actuation of said first releasable locking means and said second releasable locking means in response to the concurrent movements of the tee member and the transfer member, (i) said transfer member, when the tee member is in the upper ball receiving position therefor, being releasably locked by said second locking means on movement thereof from the first position to the second position therefor in response to the weight of a ball delivered thereon from said chute and being sequentially released by the second locking means for movement from the second position to the first position therefor, and releasably locked in the first position therefor by the first releasable locking means, in response to the movement of the tee member from the upper ball receiving position to the lower ball driving position therefor, (j) said first releasable locking means being released in response to the driving of a ball from the tee member to provide for the movement of the transfer member from the first position to the second position therefor, in response to the weight of a next lead ball delivered from the chute, (k) means for releasing the lead ball for delivery on the transfer member in response to movement of the transfer member from the second position to the first position therefor, (l) said ball transfer member having an angulate shape with a pair of upwardly diverged leg sections, one of which extends longitudinally over said projected base section, (m) means for pivotally supporting the ball transfer member on the frame structure adjacent the junction of said leg sections for pivotal movement about a horizontal axis extended transversely of the frame structure, (n) with the other of said leg sections having a terminal end movable to a position adjacent the outlet end of said discharge chute, (o) a pocket means at said terminal end for receiving a ball from said discharge chute when the transfer member is in the first position therefor, and (p) means on said frame structure for ejecting the ball from said pocket when the transfer member is moved to the second position therefor.

4. A golf ball practice driving apparatus for successively teeing up golf balls comprising:

(a) ground supported upright frame structure including a base member having a section projected from one end of said frame structure, (b) a tee member projected upwardly from said base section and movably supported on said base member for movement from an upper ball receiving position to a lower ball driving position, said tee member movable from the ball receiving position to the ball driving position therefor by the weight of a ball received thereon, (c) a container for golf balls mounted on a upper portion of said frame structure having a discharge chute for a single row of golf balls, (d) means on said frame structure for releasing only the lead ball from said chute, (e) a ball transfer member movable from a first position to receive a ball thereon to a second position to transfer the ball to a teed position on said tee member, when the tee member is in the ball receiving position therefor, (f) first means for releasably locking the transfer member in said first position, when the tee member is in the lower ball driving position therefor, (g) second means for releasably locking the transfer member in said second position, when the tee member is in the upper ball receiving position therefor, (h) means interconnecting said transfer member and tee member for actuation of said first releasable locking means and said second releasable locking means in response to the concurrent movements of the tee member and transfer member, (i) said transfer member, when the tee member is in the upper ball receiving position therefor, being releasably locked by said second locking means on movement thereof from the first position to the second position therefor in response to the weight of a ball delivered thereon from said chute and being sequentially released by the second locking means for movement from the second position to the first position therefor, and releasably locked in the first position therefor by the first releasable locking means, in response to the movement of the tee member from the upper ball receiving position to the lower ball driving position therefor, (j) said first releasable locking means being released in response to the driving of a ball from the tee member to provide for the movement of the transfer member from the first position to the second position therefor, in response to the weight of a next lead ball delivered from the chute, and (k) means for releasing the lead ball for delivery on the transfer member in response to movement of the transfer member from the second position to the first position therefor, (l) said ball transfer member having an angulate shape with a pair of upwardly diverged leg sections, one of which extends longitudinally over said projected base section, and (m) means for pivotally supporting the ball transfer member on the frame structure adjacent the junction of said leg sections for pivotal movement about a horizontal axis extended transversely of the frame structure, (n) with said one leg section projected over said base section with the terminal end thereof adjacent the tie member, and (o) means at said terminal end for confining and guiding a ball to a teed position on the tee member when the transfer member is in the second position therefor.

5. The golf driving apparatus according to claim 4 wherein:

(a) said confining and guiding means includes an arcuate member projected outwardly from said terminal end and having an upright wall movable to a position about the upper end of the tee member and in a substantially concentric spaced relation therewith, when the transfer member is in the second position therefor, and to a position about the lower portion of the tee member when the transfer member is in the first position therefor.

* * * * *